US009672995B2

(12) United States Patent
Cardwell et al.

(10) Patent No.: US 9,672,995 B2
(45) Date of Patent: Jun. 6, 2017

(54) METHODS AND APPARATUS FOR AN IMPROVED MAGNETIC ARMATURE SELECTIVE TRIPPING DEVICE OF A CIRCUIT BREAKER

(75) Inventors: Justin Michael Cardwell, Dacula, GA (US); Luis Miguel Franco Caballero, Nuevo-Leon (MX)

(73) Assignee: SIEMENS AKTIENGESELLSCHAFT, München (DE)

( * ) Notice: Subject to any disclaimer, the term of this patent is extended or adjusted under 35 U.S.C. 154(b) by 42 days.

(21) Appl. No.: 14/376,679

(22) PCT Filed: Mar. 5, 2012

(86) PCT No.: PCT/US2012/027707

§ 371 (c)(1),
(2), (4) Date: Aug. 25, 2014

(87) PCT Pub. No.: WO2013/133786

PCT Pub. Date: Sep. 12, 2013

(65) Prior Publication Data

US 2015/0035630 A1 Feb. 5, 2015

(51) Int. Cl.
*H01H 3/28* (2006.01)
*H01H 3/42* (2006.01)
(Continued)

(52) U.S. Cl.
CPC ..... *H01H 3/28* (2013.01); *H01H 3/42* (2013.01); *H01H 69/01* (2013.01);
(Continued)

(58) Field of Classification Search
CPC ..... H01H 69/01; H01H 71/2463; H01H 71/7409; H01H 71/7463; H01H 2069/016
(Continued)

(56) References Cited

U.S. PATENT DOCUMENTS 3,319,195 A 5/1967 Brumfield
4,603,312 A * 7/1986 Conner ..... H01H 71/7463 335/176

FOREIGN PATENT DOCUMENTS

CN 101145475 A 3/2008
CN 101364509 A 2/2009
(Continued)

OTHER PUBLICATIONS

PCT International Search Report mailed Nov. 30, 2012 corresponding to PCT International Application No. PCT/US2012/027707 filed Mar. 5, 2012 (12 pages).
(Continued)

*Primary Examiner* — Ramon M Barrera

(57) ABSTRACT

Methods, apparatus, and systems are provided for a selectivity device for a circuit breaker. The invention includes a modular assembly adapted to be coupled to a load conductor assembly. The modular assembly includes a tripping plunger including a cam surface adapted to interact with a breaker tripping mechanism; an armature coupled to the tripping plunger; a yoke adapted to generate a magnetic field in response to an electric current in the load conductor assembly and disposed to apply a magnetic force proportionate to the electric current on the armature; and a spring assembly adapted to counter-balance the magnetic force up to a predefined tripping current in the load conductor assembly. Numerous additional aspects are disclosed.

19 Claims, 11 Drawing Sheets

(51) Int. Cl.

| | |
|---|---|
| ***H01H 71/24*** | (2006.01) |
| ***H01H 69/01*** | (2006.01) |
| ***H01H 71/10*** | (2006.01) |
| *H01H 71/74* | (2006.01) |
| *H01H 71/12* | (2006.01) |

(52) U.S. Cl.
CPC .... *H01H 71/1081* (2013.01); *H01H 71/2463* (2013.01); *H01H 71/7463* (2013.01); *H01H 71/7409* (2013.01); *H01H 2069/016* (2013.01); *H01H 2071/124* (2013.01)

(58) Field of Classification Search
USPC ..... 335/21, 174–176
See application file for complete search history.

(56) References Cited

FOREIGN PATENT DOCUMENTS

| | | | |
|---|---|---|---|
| FR | 1423090 | A | 1/1966 |
| GB | 1249508 | A | 10/1971 |

OTHER PUBLICATIONS

Translation of Chinese Office Action mailed Dec. 22, 2015 corresponding to Chinese Application No. 201280071212.8 filed Mar. 5, 2012 (33 pages).

* cited by examiner

METHODS AND APPARATUS FOR AN IMPROVED MAGNETIC ARMATURE SELECTIVE TRIPPING DEVICE OF A CIRCUIT BREAKER

FIELD OF THE INVENTION

The present invention generally relates to circuit breakers, and more particularly is directed to methods and apparatus for an improved magnetic armature selective tripping device of a circuit breaker.

BACKGROUND OF THE INVENTION

Modern electrical distribution circuits are fed from a step down transformer which takes in higher transmission voltages (e.g., 1000s of volts) used for transmission and converts the voltages to lower, more usable voltages. As a general rule, distribution networks are designed with higher amperage and voltage rated circuit protection devices closer to the transformer and lower amperage and voltage rated protection devices further away from the transformer. An example of a simple power distribution network 100 is illustrated in FIG. 1. In the example, a step down transformer 102 is coupled to a "downstream" 2000 amp circuit breaker 104 which protects three downstream 800 amp circuit breakers 106, 108, 110 in parallel on three branches. One of the 800 amp circuit breakers 106 protects three downstream 250 amp circuit breakers 112, 114, and 116 in parallel on three sub-branches. Finally, one of the 250 amp circuit breakers 116 protects three downstream 160 amp circuit breakers 118, 120, and 122 in parallel on three sub-sub-branches. With each downstream step, the amount of amperage protection required is reduced. When an electrical fault event occurs, it is desirable to maintain operation of as much service as possible to the remaining parts of the network 100. When the network 100 is able to isolate the fault event and maintain service to the rest of the network 100, the application is known as "selective." When power is lost to an unaffected part of the network 100 (i.e., the fault event only occurs on a sub-branch but causes all the upstream breakers to trip) the application is "non-selective."

FIGS. 2A and 2B more clearly illustrate the difference between a non-selective and a selective application, respectively. FIG. 2A depicts a non-selective network 200A in which a fault event 202 has caused circuit breakers 122, 116, and 106 to all trip which results in an outage 204 that leaves most of the network 200A without electrical service. In contrast, FIG. 2B depicts a selective network 200B in which a fault event 202 has caused only circuit breaker 122' to trip which results in an outage 204' that only leaves a relatively small portion of the network 200B without electrical service.

In order to be selective, the circuit protection devices (e.g., circuit breakers) must identify where the electrical fault has occurred and act accordingly as fast as possible. This means that an upstream breaker must be able to distinguish between a fault that occurs nearby, and one that occurs downstream of another breaker. A selective power distribution system means lower downtime costs for the electrical service customer and a more stable distribution network even when problems occur. In the past, this has been achieved using tripping characteristic curves.

An example of a tripping characteristic curve 300 used for selective coordination of circuit protection devices is illustrated FIG. 3. A first curve 302 represents the behavior of a downstream circuit breaker and a second curve 304 represents the behavior of a circuit breaker located immediately upstream from the downstream circuit breaker. Using tripping characteristic curves 300 to implement selectivity has many limitations which are mainly governed by the physical attributes of the contact system within the circuit breakers.

Some manufacturers have attempted to add extra devices inside the circuit breakers to increase the ability of the breaker to distinguish where an electrical fault has occurred in the dynamic breaker behavior region 306 of the tripping characteristic curve. These extra devices are typically designed as integrated components of the breaker and for the specific physical attributes of the contact system within a particular circuit breaker. These devices are not applicable or re-useable for different circuit breakers. For example, a prior art circuit breaker that includes an integrally formed, non-removable, and non-modular selectivity device is the Model Tmax T6 circuit breaker manufactured by ABB Asea Brown Boveri Ltd of Zurich, Switzerland. This example breaker includes a custom designed, integral selectivity device developed based on tripping characteristic curves. Thus, what is needed are methods and apparatus for an improved magnetic armature selective tripping device that is modular and can be easily configured for use in different circuit breakers.

SUMMARY OF THE INVENTION

Inventive methods and apparatus are provided for a selectivity device for a circuit breaker. The apparatus includes a modular assembly adapted to be coupled to a load conductor assembly. The modular assembly includes a tripping plunger including a cam surface adapted to interact with a breaker tripping mechanism; an armature coupled to the tripping plunger; a yoke adapted to generate a magnetic field in response to an electric current in the load conductor assembly and disposed to apply a magnetic force proportionate to the electric current on the armature; and a spring assembly adapted to counter-balance the magnetic force up to a predefined tripping current in the load conductor assembly.

In some other embodiments, a circuit breaker including a selectivity device is provided. The circuit breaker includes a housing enclosing the circuit breaker and the selectivity device. The selectivity device includes a modular assembly adapted to be coupled to a load conductor assembly of the circuit breaker. The modular assembly includes a tripping plunger including a cam surface adapted to interact with a breaker tripping mechanism; an armature coupled to the tripping plunger; a yoke adapted to generate a magnetic field in response to an electric current in the load conductor assembly and disposed to apply a magnetic force proportionate to the electric current on the armature; and a spring assembly adapted to counter-balance the magnetic force up to a predefined tripping current in the load conductor assembly.

In yet other embodiments, a method of selectively tripping a circuit breaker is provided. The method includes selecting a cam surface having a shape selected to configure tripping characteristics of a selectivity device for the circuit breaker; installing the selectivity device with the selected cam surface on a load conductor assembly of the circuit breaker; and monitoring current flowing through the load conductor assembly so that the selectivity device reacts to a current flow at or over a predefined amount of current.

Numerous other aspects are provided. Other features and aspects of the present invention will become more fully apparent from the following detailed description, the appended claims, and the accompanying drawings.

DETAILED DESCRIPTION

The present invention provides improved methods and apparatus for a modular, configurable, magnetic armature selective tripping device (i.e., a selectivity device) inside a molded case circuit breaker (MCCB) that may be used to improve the selective coordination between circuit protection devices in a power distribution network. The inventive selectivity device includes a tunable cam profile, a "U" shaped yoke, and springs with a relatively low spring rate that provide an increased amount of energy available for tripping the MCCB. The invention facilitates improved selectivity particularly in devices with higher levels of mechanism energy. Further, the inventive selectivity device is modular and can be configured or tuned to be attached to various different load conductor/current transformer assemblies.

The present invention helps to provide selectivity to distribution networks by enabling the MCCB to distinguish more accurately when an electrical fault event occurs proximate to the breaker and when the issue is further downstream in the network. A selectivity device embodied as a tripping device, which is magnetically activated when a specific amount of current passes through the MCCB, is used in the present invention. The specific amount of current that triggers the tripping device corresponds to a level of current which could only exist when the electrical fault is directly downstream of the MCCB where the selectivity device is installed. Instead of being based solely on specific physical attributes of the contact system of the breaker, the tripping characteristics of the selectivity device of the present invention are governed by the selected shape of a cam on the tripping plunger of the selectivity device.

In other words, a novel feature of the tripping device of the present invention is that the cam-tripping surface is tunable. This means some of the tripping characteristics can be changed by simply changing the shape of one surface. Another advantage of the present invention is its open nature. This allows selection of larger diameter springs which have a flatter spring rate. Flatter spring rates ensure that the maximum amount of energy possible is available to be used to trip the MCCB. This feature facilitates increased selectivity performance on larger breakers which have higher required tripping energy while being space constrained. Finally, the device is mounted in such a manner as to be as modular (e.g., removable as a unit, configurable for different applications/breakers) as possible, using a current carrying structure that is unique to electronic trip unit (ETU) style breakers.

Figure 1:
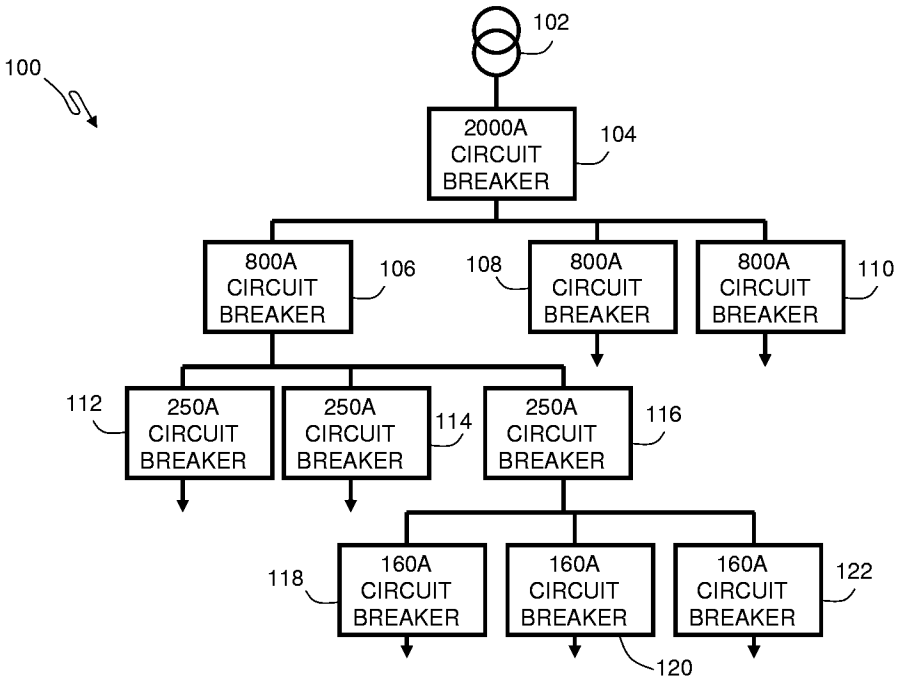
FIG. 1 is a block diagram depicting an example of a simplified power distribution network.
Figure 2A:
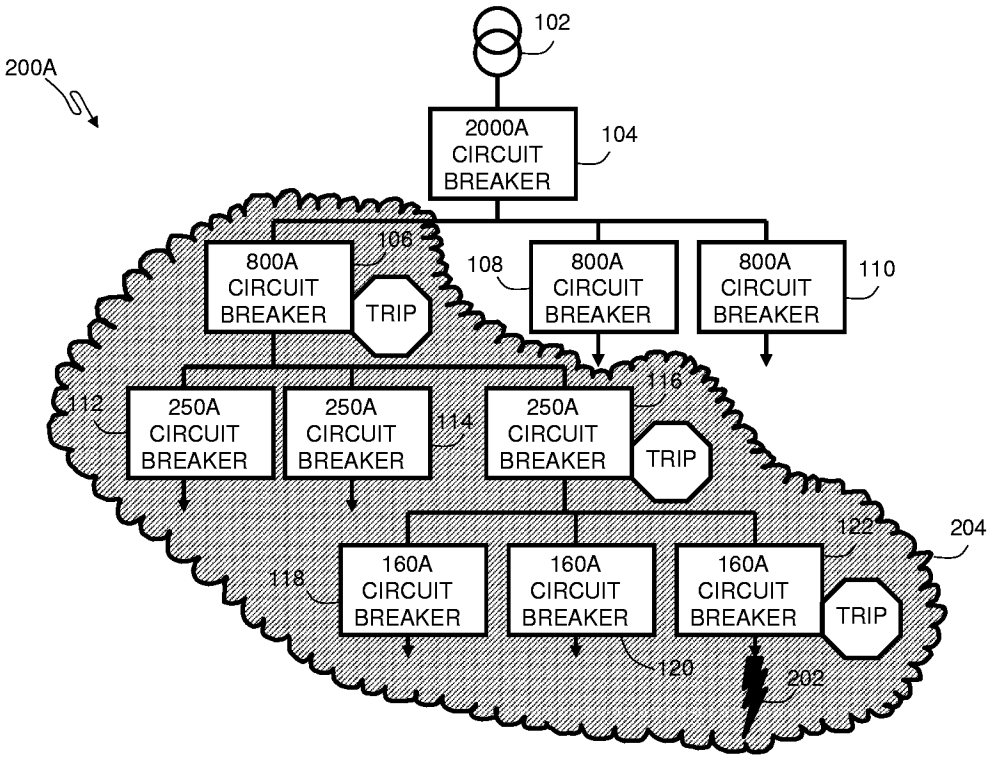
FIG. 2A is a block diagram depicting an example of a non-selective power distribution network.
Figure 2B:
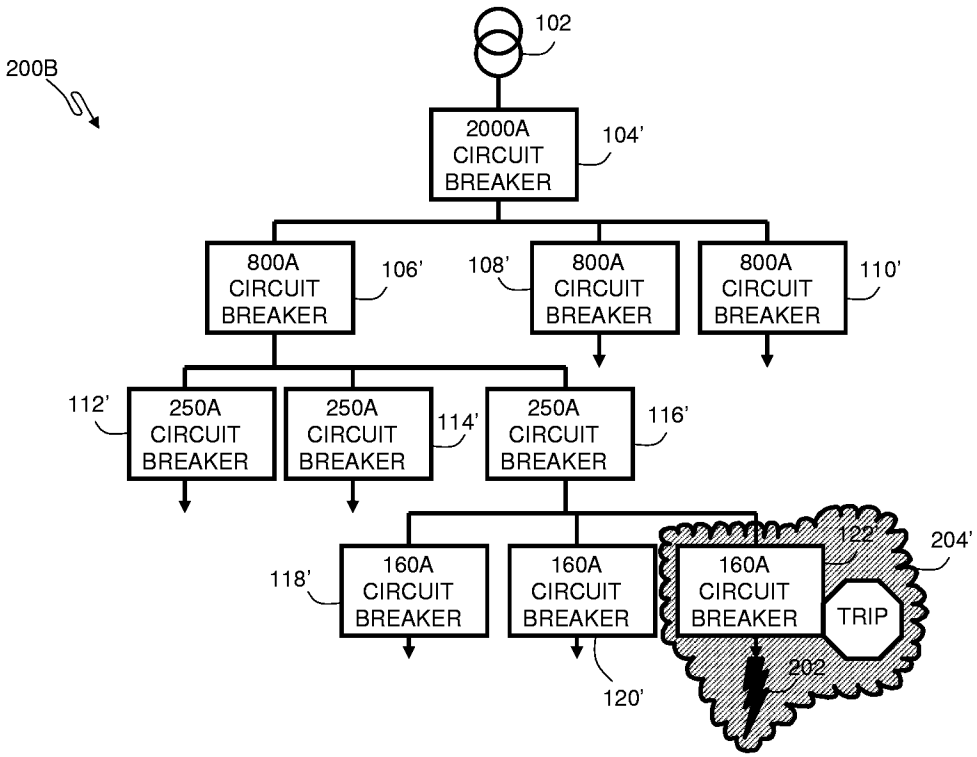
FIG. 2B is a block diagram depicting an example of a selective power distribution network according to embodiments of the present invention.
Figure 3:
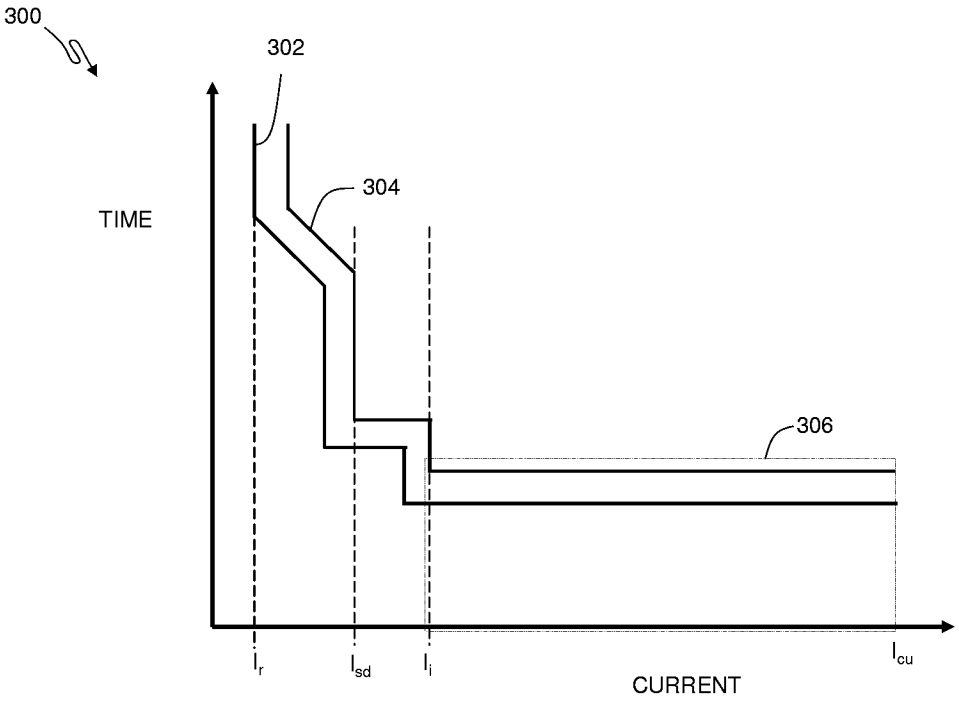
FIG. 3 is a graph depicting an example of tripping characteristics curves.
Figure 4:
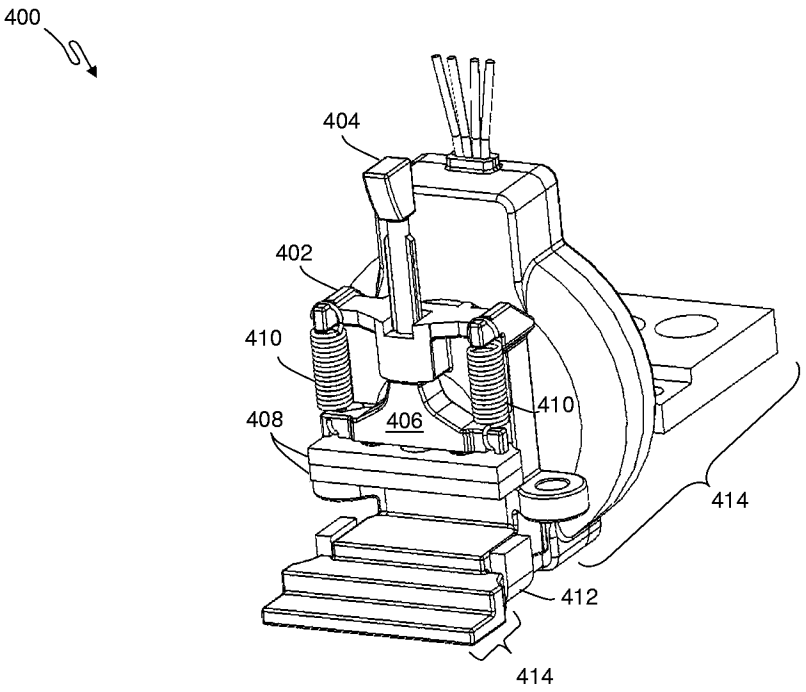
FIG. 4 is a perspective drawing of an example of a selectivity device of a circuit breaker according to embodiments of the present invention.

Turing now to FIG. 4, an example embodiment of the selectivity device 400 of the present invention is shown. In some embodiments, the selectivity device 400 includes a selectivity mounting base 402 that is adapted to be easily attached to existing circuit breakers. The base 402 supports an assembly that includes a tripping plunger 404, a tripping plunger base 406, two armature plates 408, two extension springs 410 and a yoke 412. The selectivity device 400 is mounted to a load conductor assembly 414 which is not part of the selectivity device 400.

Figure 5:
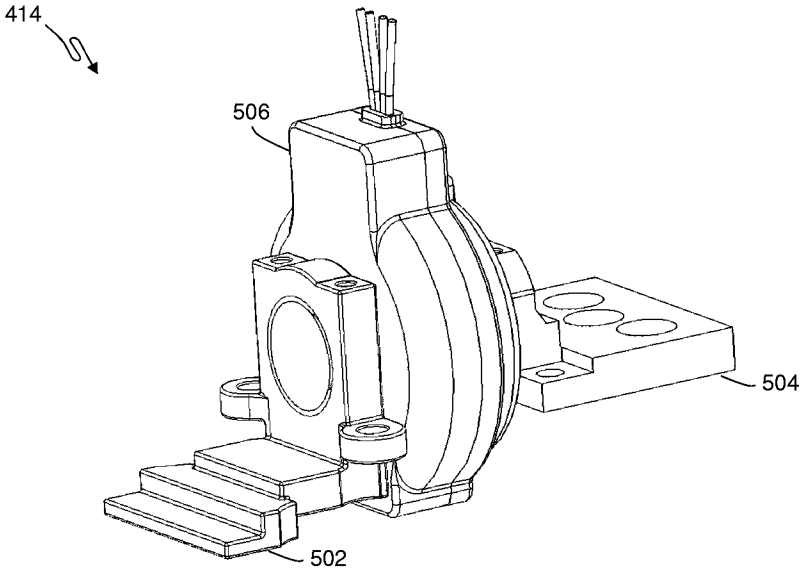
FIG. 5 is a perspective drawing of an example of a load conductor assembly of a circuit breaker according to embodiments of the present invention.

Note that the existing structure of the load conductor assembly 414 need not be modified to support the selectivity device 400 of the present invention. Thus, the selectivity device 400 is a modular assembly that can be added to or removed from an existing circuit breaker. A detailed perspective view of the load conductor assembly 414, without a selectivity device 400 mounted, is depicted in FIG. 5. The load conductor assembly 414 includes a braid terminal 502, a load side conductor 504 and a current transformer 506 disposed between. The entire selectivity device 400 may be mounted securely and reliably to the load conductor assembly 414 with only two fasteners (e.g., screws, bolts, etc.) to integrate with the current transformer 506. This arrangement allows for maximum flexibility and modularity of the design. The selectivity device 400 may be installed as an optional enhancement to an electronic trip unit (ETU) based circuit breaker or the selectivity device 400 may be easily omitted for a cost-reduced breaker when selectivity is not required. Known prior-art selectivity devices are integrally connected to and form part of the conducting path making modularity impracticable.

Figure 6:
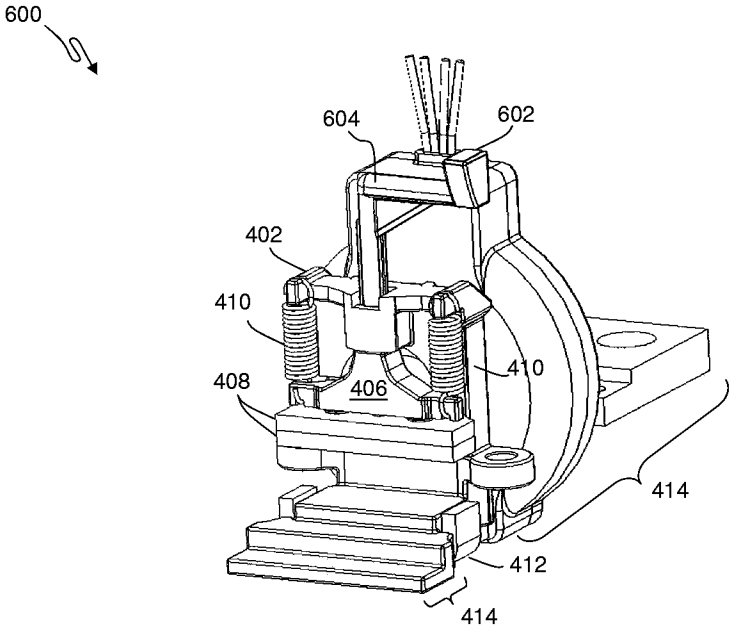
FIG. 6 is a perspective drawing of an alternative example of a selectivity device of a circuit breaker according to embodiments of the present invention.

Turning now to FIG. 6, an alternative embodiment of a selectivity device 600 according to the present invention is depicted. The alternative embodiment of the device 600 is adapted to be used in a center pole position of a circuit breaker. The structure and function of the alternative device 600 is similar to the device 400 depicted in FIG. 4 except the tripping plunger 602 includes a lateral offset member 604 that locates the cam surface off center of the load conductor assembly 414. This arrangement facilitates easy alignment of the cam surface with the tripping shaft (e.g., see FIG. 7A, 706) of the circuit breaker. Otherwise, as with the device 400 depicted in FIG. 4, the alternative device 600 includes a selectivity mounting base 402 that is adapted to be easily attached to existing load conductor assembly 414 of existing circuit breakers. Also as with the device 400 depicted in FIG.

4, the base 402 supports an assembly that includes the modified tripping plunger 602, a tripping plunger base 406, two armature plates 408, two extension springs 410 and a yoke 412.

Figure 7B:
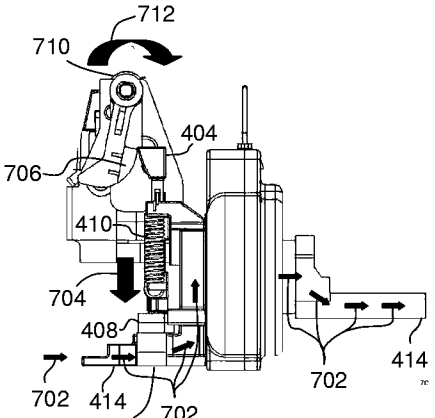
FIGS. 7A and 7B are side view drawings illustrating operation of an example selectivity device of a circuit breaker according to embodiments of the present invention.
Figure 7A:
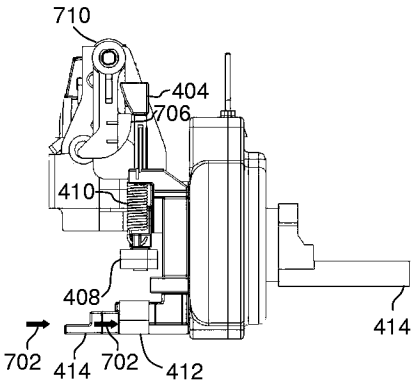

Operation of the selectivity device 400 (or 600) is illustrated in FIGS. 7A and 7B. As current (indicated by small arrows 702) passes through the load conductor assembly 414, a magnetic field (indicated by the large arrow 704) is generated in yoke 412. The magnetic field 704 forces (i.e., pulls) the metal armature plates 408 downward against the counter-force of the springs 410 toward the yoke 412. Since the armature plates 408 are attached to the tripping plunger base 406 and tripping plunger 404 (or 602), a downward motion results. The downward motion forces an interaction of the cam surface of the tripping plunger 404 (or 602) on the tripping shaft 706 of the breaker mechanism 710. The tripping shaft 706 is rotated (as indicated by arced arrow 712) by the interaction which trips the breaker as shown in FIG. 7B.

Figure 8B:
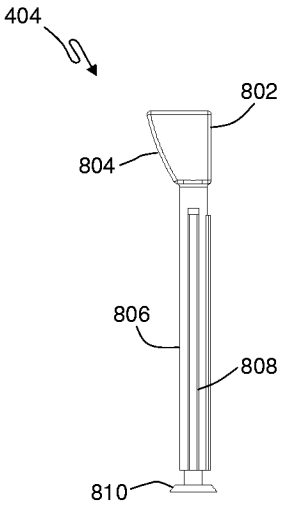
FIGS. 8A and 8B are perspective view and side view drawings respectively of a tripping plunger of an example selectivity device of a circuit breaker according to embodiments of the present invention.
Figure 8A:
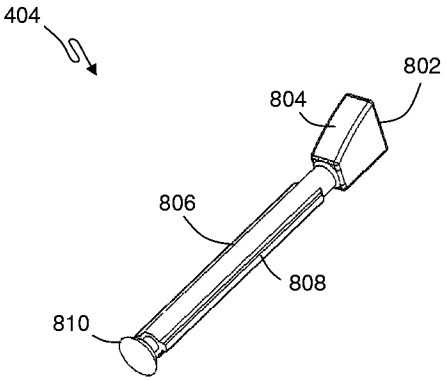

Turning now to FIGS. 8A and 8B, the tripping plunger 404 is illustrated in more detail in a perspective drawing and a side view drawing, respectively. The cam head 802 includes a cam surface 804 that is adapted to interact with the tripping shaft 706 (FIGS. 7A & 7B) of the breaker mechanism 710 (FIGS. 7A & 7B). The cam head 802 is mounted on the tripping plunger shaft 806 which includes one or more guide rails 808 to keep the tripping plunger 404 aligned as it moves up and down in matting grooves of the tripping plunger base 406 (FIG. 4). The tripping plunger 404 also includes a flange 810 which facilitates coupling to the armature plates 408 (FIG. 4).

The cam surface 804 of the tripping plunger 404 allows the selectivity device 400 to be tuned or configured for different circuit breakers and different triggering currents. By changing the shape of the cam surface 806, the amount of force required to trip the breaker can be adjusted. In some embodiments, a variety of cam heads 802 may be manufactured with different cam surfaces 804 and the desired cam surface 804 may be selected simply by choosing which cam head 802 is attached to the tripping plunger 404. Thus, dramatic variations in performance can be achieved with minimal impact to the parts.

Referring back to FIGS. 7A and 7B, it is apparent that the slope/shape of the cam surface 804 affects how quickly the selectivity device 400 will trip the breaker as the magnetic force 704 pulls down the armature plates 408 and consequently, the tripping plunger 404. In other words, if the slope/shape of the cam surface 804 is changed to be more vertical, less force is required to pull the tripping plunger 404 down but the time it takes to trip the breaker is increased. If the slope/shape of the cam surface 804 is changed to be more horizontal, more force is required to pull the tripping plunger 404 down but the time it takes to trip the breaker is decreased. In addition, the slope of the cam surface 804 can have a changing slope from the bottom to the top so that, for example, the initial force required to pull the tripping plunger 404 down is relatively low (e.g., a more vertical slope at the lower end of the cam surface) and the subsequent required force is higher but the breaker is tripped sooner (e.g., a more horizontal slope towards the upper end of the cam surface). Other shapes and performance tuning concerns may be used. In summary, the ability to tune or select the cam surface 804 afforded by the present invention changes the amount of energy required from the magnetic structure to trip the breaker and therefore, controllably and configurably allows changes to be made to the performance characteristics of the selectivity device 400.

As with any mechanical system, there is a critical amount of energy that is required to achieve a desired result. In this case, the energy of concern is that which is required to trip the breaker at the tripping shaft 706. Since the magnetic affect on the selectivity device 400 has limited margin in the amount of energy that can be provided to trip the breaker, it is desirable that the springs 410 used in the selectivity device 400 have as flat a spring rate as possible. The present invention allows for this flat rate by having an overall larger volume for the springs to occupy within the circuit breaker than prior art selectivity devices. This increased availability of volume allows for selection of springs 410 with larger diameters. Larger diameter springs 410 mean flatter spring rates. For example, in a selectivity device for a 1000 amp circuit breaker that is designed to trip at 35000 amps, springs with a diameter of approximately 5.5 mm to 8 mm, and a spring rate of approximately 2.5 N/mm to 0.7 N/mm may be used. In prior art selectivity devices, the springs are typically internal to the load bus and are thus much more constricted by available space. Therefore, the prior art devices typically result in less energy available to trip the breaker.

Another advantage of the increased available volume of the present invention, allows the use multiple springs rather than a single spring. When multiple springs are used, larger magnetic attraction forces between the armature plates 408 and the yoke 412 can be accommodated and therefore, the activation point of the selectivity device 410 can be higher.

Figure 9:
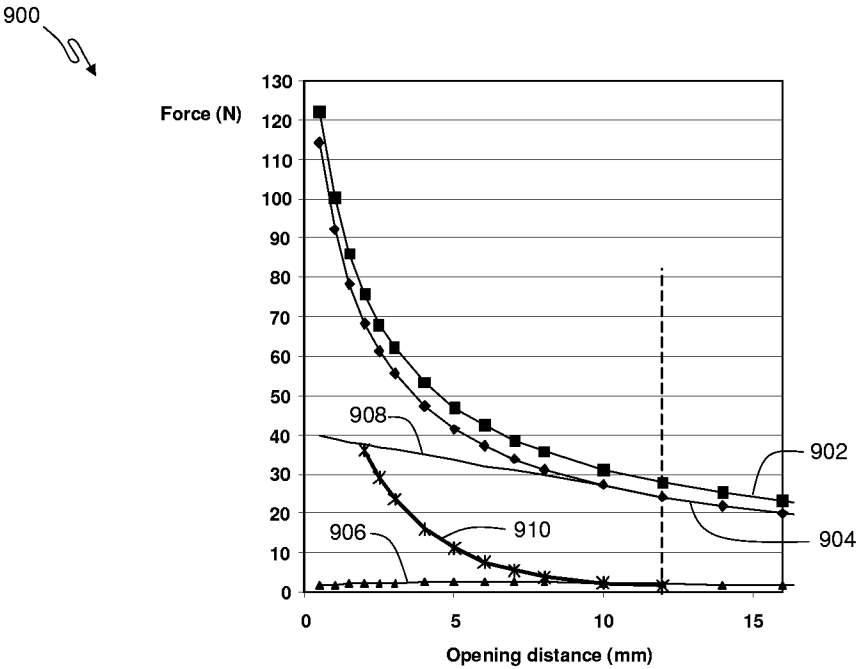
FIG. 9 is a graph depicting how the force available for tripping a breaker using the selectivity device of the present invention can be calculated according to embodiments of the present invention.

Turning to FIG. 9, the relationship between the force available for tripping the breaker, the magnetic force of the yoke 412, the spring rate of the springs 410, the opening distance between the yoke 412 and armature plates 408, and the friction loss from lateral magnetic forces is illustrated in a graph 900. The relationship can be represented by the equation:

$$F=F_A-F_{spr}-F_f$$

where F represents the force available for tripping the breaker, $F_A$ represents the vertical magnetic force at the desired "must trip" amperage, $F_{spr}$ represents the calibrated spring force to be exerted at the desired "no trip" amperage, and $F_f$ represents the friction loss from lateral magnetic forces. To clarify, $F_{spr}$ is calibrated to be an amount of upward force exerted by the springs sufficient to prevent downward motion of the armature plates 408 at the desired "no trip" amperage. Referring the example graph of FIG. 9, curve 902 represents a plot of $F_A$ at an example "must trip" amperage of 35 kA. Curve 904 represents a plot of $F_{spr}$ at an example "no trip" amperage of 30 kA. Curve 906 represents a plot of $F_f$. Line 908 represents a plot of the spring force calibrated to resist 30 kA at an opening of 12 mm between the yoke 412 and armature plates 408. Finally, curve 910 represents the force available for tripping the circuit breaker calculated based on the above equation.

Figure 10:
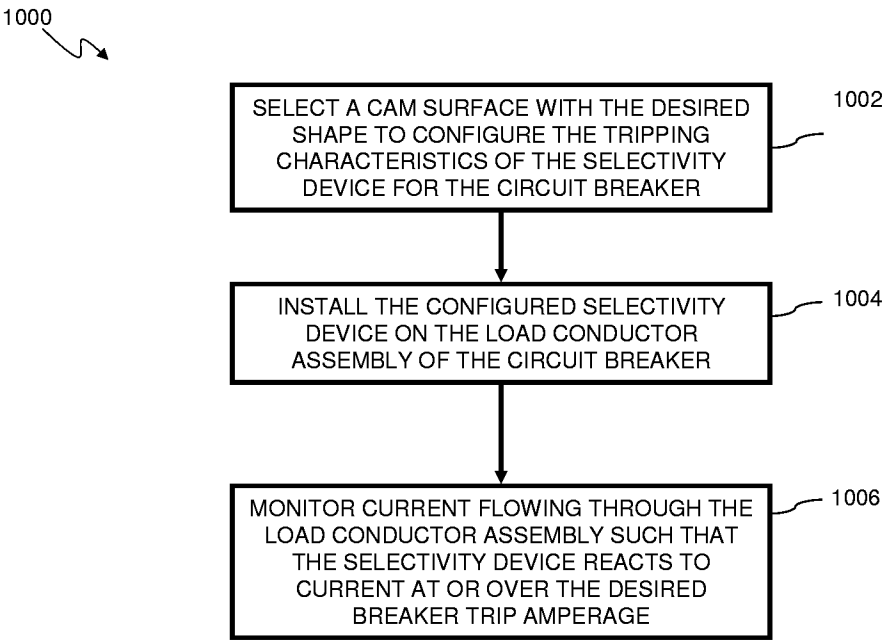
FIG. 10 is a flow chart depicting an example method of tripping a circuit breaker using the using the selectivity device of the present invention according to embodiments of the present invention.

Turning now to FIG. 10, an example method 1000 of using the selectivity device of the present invention to selectively trip a circuit breaker is depicted as a flow chart. In step 1002, a cam surface 804 of a cam head 802 of a tripping plunger 404 of the selectivity device 400 is selected with the desired shape to adjust or configure the tripping characteristics of the selectivity device 400 for the circuit breaker. In step 1004, the selectivity device including the selected cam surface 804 is installed on the load conductor assembly 414 of the circuit breaker and disposed to interact with the tripping shaft 706 of the breaker mechanism 710. In step 1006, the selectivity device 400, which is monitoring the current flowing through the load conductor assembly 414, reacts to current at or over the desired breaker trip amperage. By energizing the yoke 412 in response to the specific current to generate sufficient downward magnetic force to overcome the spring force on the armature plates, the device 400 pulls the tripping plunger 404 to cause the cam surface to interact with the tripping shaft 706 of the breaker mechanism 710 and thereby trip the breaker.

Accordingly, while the present invention has been disclosed in connection with the preferred embodiments thereof, it should be understood that other embodiments may fall within the spirit and scope of the invention, as defined by the following claims.

The invention claimed is:

1. A selectivity device for a circuit breaker, the selectivity device comprising:

a modular assembly adapted to be coupled to a load conductor assembly, the modular assembly including:

a tripping plunger including a cam surface adapted to interact with a breaker tripping mechanism, the cam surface having a shape selected to configure tripping characteristics of the selectivity device for the circuit breaker such that the shape to provide a cam profile that is tunable to change an amount of energy required from a magnetic structure to trip the circuit breaker;

an armature coupled to the tripping plunger;

a yoke adapted to generate a magnetic field in response to an electric current in the load conductor assembly and disposed to apply a magnetic force proportionate to the electric current on the armature; and a spring assembly adapted to counter-balance the magnetic force up to a predefined tripping current in the load conductor assembly, the spring assembly is configured to enable selection of springs to provide a spring rate profile that changes an amount of energy available to trip the circuit breaker.

2. The apparatus of claim 1 wherein the modular assembly can be removed from the load conductor assembly without altering circuit protection features of the circuit breaker.

3. The apparatus of claim 1 wherein the tripping plunger is adapted to allow tripping characteristics of the selectivity device to be adjusted by changing the cam surface.

4. The apparatus of claim 3 wherein the shape of the cam surface affects the rate at which the selectivity device reacts to the predefined tripping current in the load conductor assembly.

5. The apparatus of claim 3 wherein the shape of the cam surface affects the amount of force needed for the selectivity device to trip the circuit breaker.

6. The apparatus of claim 1 wherein the tripping plunger includes a cam head including the cam surface and wherein the cam head is adapted to be replaced with an alternate cam head with a different cam surface.

7. The apparatus of claim 1 wherein the spring assembly includes two or more springs.

8. A circuit breaker comprising:

a housing enclosing the circuit breaker and a selectivity device, the selectivity device including:

a modular assembly adapted to be coupled to a load conductor assembly of the circuit breaker, the modular assembly including:

a tripping plunger including a cam surface adapted to interact with a breaker tripping mechanism, the cam surface having a shape selected to configure tripping characteristics of the selectivity device for the circuit breaker such that the shape to provide a cam profile that is tunable to change an amount of energy required from a magnetic structure to trip the circuit breaker;

an armature coupled to the tripping plunger;

a yoke adapted to generate a magnetic field in response to an electric current in the load conductor assembly and disposed to apply a magnetic force proportionate to the electric current on the armature; and a spring assembly adapted to counter-balance the magnetic force up to a predefined tripping current in the load conductor assembly, the spring assembly is configured to enable selection of springs to provide a spring rate profile that changes an amount of energy available to trip the circuit breaker.

9. The circuit breaker of claim 8 wherein the modular assembly can be removed from the load conductor assembly without altering circuit protection features of the circuit breaker.

10. The circuit breaker of claim 8 wherein the tripping plunger is adapted to allow tripping characteristics of the selectivity device to be adjusted by changing the cam surface.

11. The circuit breaker of claim 10 wherein the shape of the cam surface affects the rate at which the selectivity device reacts to the predefined tripping current in the load conductor assembly.

12. The circuit breaker of claim 10 wherein the shape of the cam surface affects the amount of force needed for the selectivity device to trip the circuit breaker.

13. The circuit breaker of claim 8 wherein the tripping plunger includes a cam head including the cam surface and wherein the cam head is adapted to be replaced with an alternate cam head with a different cam surface.

14. The circuit breaker of claim 8 wherein the spring assembly includes two or more springs.

15. A method of selectively tripping a circuit breaker, the method comprising:

selecting a cam surface having a shape selected to configure tripping characteristics of a selectivity device for the circuit breaker, wherein the cam surface having the shape to provide a cam profile that is tunable to change an amount of energy required from a magnetic structure to trip the circuit breaker;

installing the selectivity device with the selected cam surface on a load conductor assembly of the circuit breaker; and monitoring current flowing through the load conductor assembly so that the selectivity device reacts to a current flow at or over a predefined amount of current, wherein the selectivity device including a spring assembly that is configured to enable selection of springs to provide a spring rate profile that changes an amount of energy available to trip the circuit breaker, wherein installing the selectivity device includes installing the selectivity device including:

a modular assembly adapted to be coupled to the load conductor assembly of the circuit breaker, the modular assembly including:

a tripping plunger including the cam surface which is adapted to interact with a breaker tripping mechanism;

an armature coupled to the tripping plunger;

a yoke adapted to generate a magnetic field in response to an electric current in the load conductor assembly and disposed to apply a magnetic force proportionate to the electric current on the armature; and the spring assembly including two or more springs and adapted to counter-balance the magnetic force up to the predefined amount of current in the load conductor assembly.

16. The method of claim 15 wherein the modular assembly can be removed from the load conductor assembly without altering circuit protection features of the circuit breaker.

17. The method of claim 15 wherein the tripping plunger is adapted to allow tripping characteristics of the selectivity device to be adjusted by selecting a different cam surface.

18. The method of claim 17 wherein the shape of the cam surface affects the rate at which the selectivity device reacts to the predefined amount of current in the load conductor assembly.

19. The method of claim 17 wherein the shape of the cam surface affects the amount of force needed for the selectivity device to trip the circuit breaker.

* * * * *